US008944414B2

(12) United States Patent
Sprague

(10) Patent No.: US 8,944,414 B2
(45) Date of Patent: Feb. 3, 2015

(54) COMPONENT RAILING SYSTEM AND METHOD OF INSTALLATION

(75) Inventor: Gary Sprague, Los Angeles, CA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 0 days.

(21) Appl. No.: 11/155,214

(22) Filed: Jun. 16, 2005

(65) Prior Publication Data

US 2006/0284154 A1 Dec. 21, 2006

(51) Int. Cl.
*E04H 17/16* (2006.01)
*E04F 11/18* (2006.01)

(52) U.S. Cl.
CPC ..... *E04F 11/1812* (2013.01); *E04F 11/1834* (2013.01); *E04F 11/1851* (2013.01)
USPC ..... 256/24; 256/67

(58) Field of Classification Search
USPC ..... 256/24, 59, 67, 65.01, 65.02, 65.07, 73
See application file for complete search history.

(56) References Cited

U.S. PATENT DOCUMENTS

| | | | | | |
|---|---|---|---|---|---|
| 1,663,203 | A | * | 3/1928 | Luipersbek | 256/65.01 |
| 2,588,147 | A | * | 3/1952 | Morris | 256/73 |
| 2,870,996 | A | * | 1/1959 | Helt | 256/65.06 |
| 3,395,489 | A | * | 8/1968 | Banse | 256/24 |
| 3,452,501 | A | * | 7/1969 | Sickler et al. | 52/241 |
| 3,770,245 | A | * | 11/1973 | Murdock | 256/65.08 |
| 3,918,686 | A | * | 11/1975 | Knott et al. | 256/65.08 |
| 3,933,311 | A | * | 1/1976 | Lemelson | 256/24 |
| 4,014,520 | A | * | 3/1977 | Walters | 256/65.11 |
| 4,149,352 | A | * | 4/1979 | Allen | 403/231 |
| 4,188,019 | A | * | 2/1980 | Meredith | 256/24 |
| 4,214,734 | A | * | 7/1980 | Stafford | 256/65.09 |
| 4,364,546 | A | * | 12/1982 | Lyman et al. | 256/24 |
| 4,369,953 | A | * | 1/1983 | Greiner et al. | 256/24 |
| 4,421,302 | A | * | 12/1983 | Grimm et al. | 256/67 |
| 4,623,128 | A | * | 11/1986 | Dutch et al. | 256/65.08 |
| 4,690,383 | A | * | 9/1987 | Batcheller | 256/24 |
| 4,841,697 | A | * | 6/1989 | Hogg et al. | 256/24 |
| 4,920,717 | A | * | 5/1990 | Hooper, Jr. | 256/24 |
| 5,026,028 | A | * | 6/1991 | Ooi et al. | 256/67 |
| 5,078,367 | A | * | 1/1992 | Simpson et al. | 256/24 |
| 5,200,240 | A | * | 4/1993 | Baker | 256/65.11 |
| 5,402,988 | A | * | 4/1995 | Eisele | 256/24 |
| 5,437,433 | A | * | 8/1995 | Rezek | 256/67 |
| 5,584,469 | A | * | 12/1996 | Goodwin | 256/67 |
| 5,649,688 | A | * | 7/1997 | Baker | 256/59 |

(Continued)

FOREIGN PATENT DOCUMENTS

| | | | | |
|---|---|---|---|---|
| DE | 19811750 | A1 | * | 9/1999 |
| EP | 651097 | A1 | * | 5/1995 |

(Continued)

OTHER PUBLICATIONS

The Wagner Companies, R&B Wagner 50th Anniversary Catalog 1955-2005 (2005), Cover and pp. 1, 4-8 and 64-72.

*Primary Examiner* — Victor MacArthur
(74) *Attorney, Agent, or Firm* — Cislo & Thomas, LLP

(57) ABSTRACT

A component railing system and method of use is provided in which railings may be installed with less time and customization over known systems. In particular, two embodiments of the present invention allow mounting of a cap rail to a post or a bracket. The resulting configurations allow quick installation or replacement of panels, which are supported by the cap rail and base shoe.

14 Claims, 9 Drawing Sheets

(56) References Cited

U.S. PATENT DOCUMENTS

| | | | | | |
|---|---|---|---|---|---|
| 5,702,090 | A * | 12/1997 | Edgman | 256/24 | |
| 6,017,019 | A * | 1/2000 | Erwin | 256/65.05 | |
| 6,029,954 | A * | 2/2000 | Murdaca | 256/65.08 | |
| 6,283,457 | B1 * | 9/2001 | Venegas, Jr. | 256/65.05 | |
| 6,655,062 | B1 * | 12/2003 | Meeker | 40/611.05 | |
| 6,938,882 | B2 * | 9/2005 | Hadfield et al. | 256/65.01 | |
| 6,964,410 | B1 * | 11/2005 | Hansen | 256/65.02 | |
| 7,017,320 | B2 * | 3/2006 | Chen | 256/24 | |
| 2003/0085395 | A1 * | 5/2003 | Gardner | 256/65.02 | |
| 2005/0035341 | A1 * | 2/2005 | Montgomery | 256/65.11 | |

FOREIGN PATENT DOCUMENTS

| | | | | | |
|---|---|---|---|---|---|
| EP | 1219759 | A2 * | 7/2002 | | |
| FR | 2857394 | A1 * | 1/2005 | | |
| FR | 2861776 | A1 * | 5/2005 | | |
| GB | 2375551 | A * | 11/2002 | | |
| WO | WO 2004046486 | A1 * | 6/2004 | | E04F 11/18 |
| WO | WO 2005028776 | A1 * | 3/2005 | | |
| WO | WO 2006105591 | A1 * | 10/2006 | | |

* cited by examiner

COMPONENT RAILING SYSTEM AND METHOD OF INSTALLATION

FIELD OF THE INVENTION

The present invention relates to railing systems.

BACKGROUND OF THE INVENTION

Various types of railing systems are known. Generally speaking, railings can serve to divide an area into two or more regions and also can serve safety functions. For example, railings are conventionally found where there is a change in elevation, such as at a landing or as a guide on a stairway, or as guides on pathways.

Railing systems often include plate glass panels or other planar structures. Examples of systems that secure planar structures are post railing systems, aluminum railing systems, and cap railing systems. These types of systems can suffer from a number of disadvantages, such as labor intensive installation, and requirements for customized components. Customized components, are undesirable because of increased time and labor costs required when taking measurements, crafting the components, and then installing the system. Additionally, customized components may not have the same appearance as "off the shelf" components that may be used in the same system. An example of a customized component is an angled section such as used at corners and angle transitions.

One example of a post railing system is the CLR HRS Post Railing System from C. R. Laurence, Company, as shown in Railing Systems Catalog HR05, pages R87-93 (2004). Such a railing system can be constructed of posts, such as made from stainless steel or brass, which are fixed in the ground. Between the posts are panels made of glass or other materials that are held in place by a plurality of clamps and are supported by the posts. Each post has a "saddle cut" at the top, into which an upper rail may be welded into place. In this type of railing system, the upper rail is supported by the posts and is often comprised of pipe. A disadvantage of this system, however, is the need to custom fabricate some of its components. As a result, installation or fabrication times may be longer than otherwise possible via the use of standardized, or "off-the-shelf" components. Accordingly, there is a need for a railing system that requires a reduced amount of custom parts reducing installation and fabrication times and expenses.

Another type of known railing system is an aluminum railing system, such as available from C. R. Laurence, Company, as shown in Railing Systems Catalog HR05, page R94-R103 (2004). Such a system employs a post fastened to the ground, to which top and bottom rails are fastened with nuts, bolts, screws, or other hardware. Various materials can be placed between the top and bottom rails, such as glass or pickets. One disadvantage of this type of system involves the manner of attaching the rails to the posts. In particular, mechanical fasteners may be aesthetically unappealing and also subject to undesired tampering or removal.

Another type of railing system is a cap railing system, such as available form C. R. Laurence, Company, as shown in Railing Systems Catalog HR05, pages R37-R62 (2004). Such a system can include several glass panels mounted to the ground and extending vertically. A cap rail is provided that has a channel extending along its bottom surface. The cap rail is affixed to the top edge of the glass panels. Unlike the post railing system, the rail in the cap railing system is supported by the glass panels.

Generally speaking, building codes can require at least three glass panels to be used with a cap railing system so as to enhance safety in case one of the glass panels breaks. Such design requirements have the disadvantage of requiring a minimum number of panels as dictated by safety concerns, and thereby decreasing design flexibility and impairing visual appearance in some circumstances. An example of this disadvantage may occur when an architect wishing to design a cap railing system having two glass panels may be forced to choose between a three-panel cap railing system or a two-panel post railing system. A further disadvantage of such a cap railing system is that if a glass panel breaks, the repairs involve removal of the cap rail from several glass panels to allow replacement of the broken panel, making repair more time consuming and costly.

Accordingly, there is need of an improved railing system that does not rely on glass panels to support the cap rail and can be installed, maintained and repaired economically and in a time efficient fashion. There is also a need of an aesthetically pleasing railing system employing glass and other materials that requires less customization than other known systems and can be provided with many standardized components reducing installation costs, time and so on.

SUMMARY OF THE INVENTION

The present invention alleviates to a great extent the disadvantages of the known railing systems by providing a component railing system and method of railing installation in which one or more posts are provided and mounted on a mounting surface, such as a floor, staircase or ground. Post-mounted fittings provided, which support a cap rail. At least one fitting is affixed to the top of each post, and a cap rail is then mounted to the fittings. The cap rail preferably defines a downward facing cap rail channel. As a lower mounting surface, a base shoe having an upwardly facing channel is provided. Panels of glass or other generally planar members are positioned within the channels. In installation, the panels can be individually installed by first lifting the upper edge into the cap rail and then lowering the bottom edge into the upwardly facing open channel of the base shoe. With this design, the cap rail is supported by the fittings on the posts, and the lower rail channel provides support to the planar inserts. In installation, the fittings and cap rail can be secured by adhesive bonding. In operation a panel can be replaced should it become damaged or otherwise broken. Once the original panel (or remaining portions thereof) is removed, the replacement panel may be inserted by positioning in the upper channel followed by lowering into the lower channel.

In another embodiment of the invention, brackets can be used to support the cap rail. In this aspect, the brackets are not necessarily mounted to a post, and may be attached to other surfaces, such as a wall or ceiling. As in the previously-mentioned embodiment, the cap rail is supported by fittings, and the panels can be replaced without removal of the cap rail.

These and other features and advantages of the present invention will be appreciated from review of the following detailed description of the invention, along with the accompanying figures in which like reference numerals refer to like parts throughout.

DETAILED DESCRIPTION OF THE INVENTION

In the following paragraphs, the present invention will be described in detail by way of example with reference to the accompanying drawings. Throughout this description, the preferred embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Figure 1:
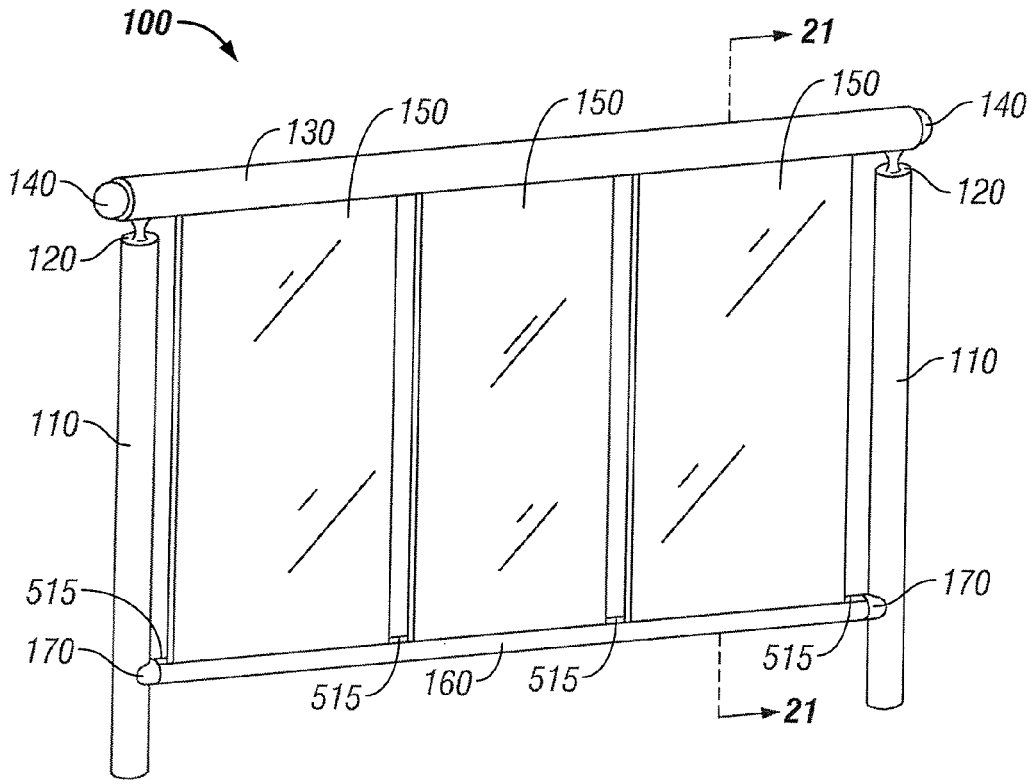
FIG. 1 is a perspective view of an embodiment of a component railing system in accordance with the present invention.

An embodiment of a component railing system 100 is shown in FIG. 1. This embodiment includes: posts 110, post support fittings 120, cap rail(s) 130, cap rail end pieces 140, panel 150, base shoe(s) 160, and base shoe transition end pieces 170. The posts 110 preferably are fixed at their bases, such as by cement. Post-support fittings 120 are mounted at the top ends of the posts 110. Much of (or all of) the load from the cap rail 130 is borne by the post-support fittings 120. Preferably, the post-support fittings 120 are bonded (i.e. using an adhesive) to their respective posts 110. Alternatively, the post-support fittings 120 are attached by any securing apparatus or technique that can sufficiently affix the post-support fittings 120 to their respective posts 110 while sufficiently supporting the rail(s) 130 supported thereon. Examples of alternative securing systems or techniques include without limitation, welds, bolts, screws, force fits, or other means of affixation. Likewise, the cap rail(s) 130 are affixed to post-support fittings 120 by any apparatus or technique that can sufficiently secure them to one another under the conditions of use. Adhesives preferably are used although welds, bolts, screws, force fits etc. may be used.

The cap rail 130 defines a cap rail channel 410 that preferably extends the entire length along the underside of the cap rail 130. Alternatively, the cap rail channel may extend along only a desired section of the cap rail 130, where it is desired to mount panel(s) 150. Optionally, cap rail end pieces 140 may be attached to one or both ends of a cap rail 130. Cap rail end pieces 140 may provide a protective cover over an opening at the end of a non-solid cap rail 130 adding to safety and aesthetic appearance.

Opposite the cap rails 130 are one or more base shoes 160. The base shoes 160 can have numerous configurations, but preferably define an upwardly facing base shoe channel 510, as discussed below. Preferably, the base shoe channel 510 corresponds in length and orientation to the corresponding cap rail channel 410.

In a preferred embodiment as shown in FIG. 1, base shoe 160 is attached to the post 110. In other preferred embodiments, the base shoe 160 is affixed to the ground, floor, or other surface. At either end of the base shoe 160 may be a base shoe transition end piece 170. As shown in the embodiment of a component railing system 100 in FIG. 1, the base shoe transition end piece 170 may include a "saddle cut" approximating the exterior shape of the post 110.

Extending between the base shoe 160 and the rail cap 130 may be one or more panels 150. Much of the load from the panels 150 is borne by the base shoe 160. These panels 150 may be glass, Plexiglas, wood, metal, or other material, and may contain designs or other features as desired by the architect, installer, or other user. FIG. 1 depicts an embodiment of a component railing system 100 that incorporates three panels 150 constructed of tempered glass, although it should be understood that a single glass panel also may be used between posts 110 (such as panel 152 illustrated in FIG. 2), or other numbers as well.

Pocket filler channels (also known as "spacer inserts", "spacers" or "gap fillers") 515 may be positioned between panels 150 or between a panel 150 and an other adjacent component. Where there are a plurality of panels 150 between two posts 110, such as illustrated in FIG. 1, pocket fillers 515 can be positioned within one or both of the cap rail channel 410 and base shoe channel 510 (as shown in FIG. 1) between panels 150 as desired. Pocket fillers 515 also can be used in embodiments where a channel is provided in a handrail 185 as desired. In addition to being used between adjacent panels, pocket fillers 515 can be positioned between a panel and an adjacent component, such as a post 110, fitting 330, cap rail end cap 140, base shoe end cap 170, etc.

The cap rail 130 and the base shoe 160 each can be provided in a plurality of sizes and with a plurality of sizes of the respective cap rail channels 410 and base shoe channels 510. These variations permit accommodation of different sized panels and may suit different design or aesthetic preferences or applicable building codes.

Figure 2:
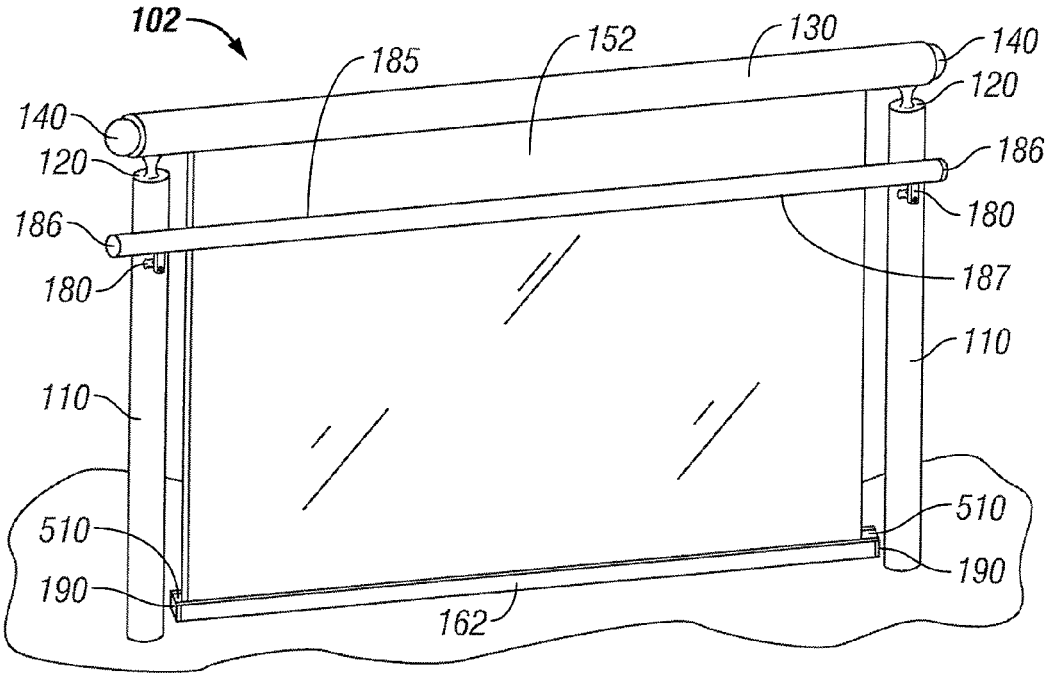
FIG. 2 is a perspective view of an embodiment of a component railing system in accordance with the present invention.

FIG. 2 depicts an embodiment of a component railing system 102 with a handrail 185 and a single glass panel 152 positioned between two posts 110. Also depicted in this figure is a handrail bracket fitting 180 that is affixed to a post 110, although other embodiments may attach the handrail bracket fitting 180 to a wall or other supportive structure. The handrail bracket fitting 180 is used to support a handrail 185, which preferably terminates in a handrail cap 186 at a free end. The handrail bracket fitting 180 supports the handrail 185 in a similar manner as described above. In this regard, the handrail bracket fitting 180 includes a component that may be attached to a channel extending along the underside of the handrail 185. Although the preferred method of attaching the handrail 185 to the handrail bracket fitting 180 is with bonding, other embodiments may utilize screws, bolts, welding, or other methods of attachment. One aspect illustrated in FIG. 2 is the option of mounting the base shoe 162 on the ground, rather than supporting it on the posts 110. In such an arrangement, the base shoe 162 optionally is capped using base cap end pieces 190 that cover over the respective ends.

In one example the embodiment shown in FIG. 2 is utilized where a handrail 185 is desired, such as on an incline or a staircase. It should be noted that optionally the base shoes 162 in such an embodiment may be mounted on the posts 110, as illustrated in FIG. 1, such as using saddles, such as the saddles incorporated into end piece 170, or end piece 172 shown in FIG. 15, alone or in conjunction with bonding or another type of attachment. In other examples, building codes may require the use of a separate handrail 185 if the corresponding cap rail 130 has a diameter greater than 2 inches. Thus, the embodiment of the component railing system 102 with a handrail 185 may be used to provide aesthetic features, useful support, and compliance with code requirements.

In another aspect of the present invention, installation and maintenance of railing systems are facilitated. The components can be adapted to a number of configurations, thereby reducing the need for customized components and simplifying repair and maintenance.

Figure 3:
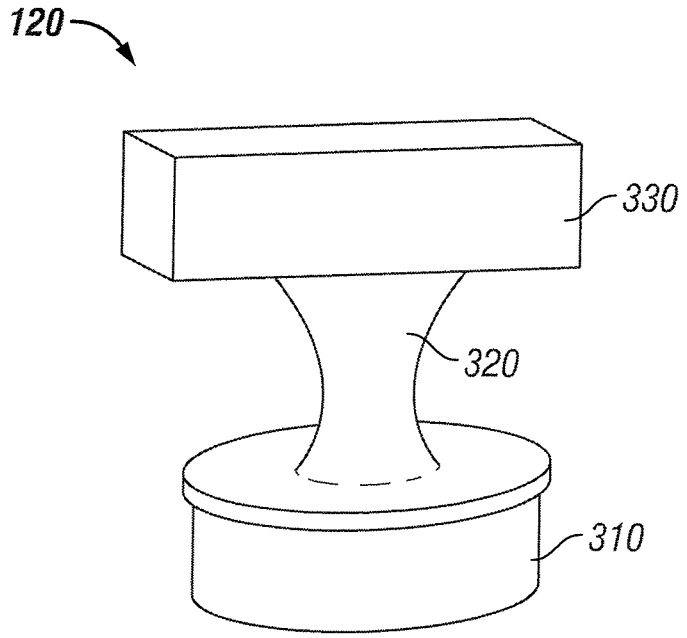
FIG. 3 is a perspective view of an embodiment of a post support fitting of a component railing system in accordance with the present invention.
Figure 4:
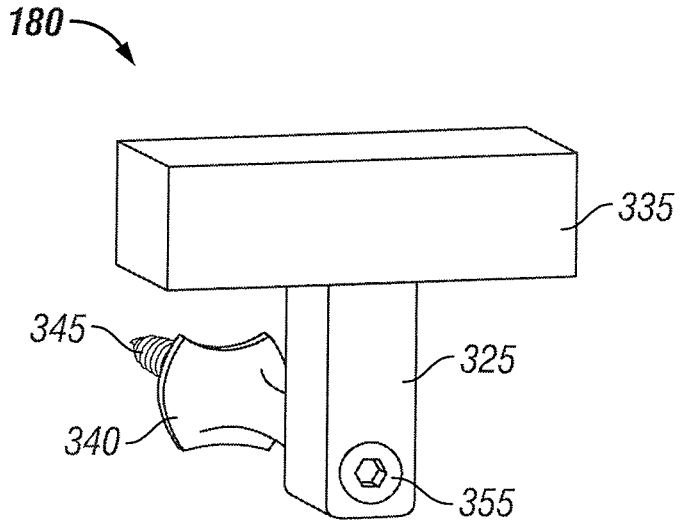
FIG. 4 is a perspective view of an embodiment of a support fitting of a component railing system in accordance with the present invention.

FIGS. 3 and 4 depict embodiments of post support fittings 120 and a handrail bracket fittings 180, respectively. These components can be fabricated of any material providing sufficient structural strength and aesthetic appeal. Generally it is preferred that a metallic alloy, such as brass or stainless steel be are used, although other metals or polymeric materials also can be used, as with the posts 110 and other components of the system. In some embodiments it is preferred that similar materials be used so as to have a consistent visual appearance.

Referring to FIG. 3, the illustrated embodiment of the post support fitting 120 includes a post fitting section 310. In a female fitting embodiment, the post fitting 310 has generally the same profile as the corresponding female fitting portion of post 110, but of a slightly smaller size, allowing the post fitting section 310 to mate with the corresponding portion of the post 110. An opposite mounting arrangement (male fitting embodiment) can be provided in which the post fitting has generally the same profile as the corresponding portion of the post 110, but of a slightly larger inner surface size, allowing the post fitting section 310 to be positioned over in mating arrangement with the corresponding portion of the post 110. As described above, any form of attachment can be used. In one example Metal Contact Cement 32649 and Primer for Metal Contact Cement 7649, both available from C. R. Laurence Company, are used, although any suitable adhesive having sufficient bonding properties to affix the post fitting 310 to the post 110 can be used.

Various design elements can be included in the post support fitting 120. It is preferred that the fitting section 310 is spatially separated from a cap rail fitting section 330, such as by a spacer or extension section 320. The extension 320 may be straight, as shown in FIG. 3, or it may be angled, curved, or otherwise varied in shape as desired, so long as sufficient structural strength is provided to support the cap rail 130. Although FIG. 3 depicts a rigid extension 320, other embodiments may include a hinge assembly 350 (FIG. 6) or other movable mounting element. This can provide additional design flexibility allowing the fitting 120 to be used for mounting the cap rails 130 at a variety of angles or orientations. Similar features may be provided with the handrail bracket fitting 180. Likewise, holes or channels may be added to either or both of these fittings to accommodate electrical connections to deliver power to lights or other electronic components. In assembly, cap rail 130 is attached to the post support fitting 120 via the cap rail fitting member 330. Preferably, the attachment is accomplished through bonding, although any suitable type of attachment can be used.

Handrail bracket fitting 180 includes a spacing section, such as extension 325 and a handrail fitting 335. The mount 340 and other components such as extension 325 can have any desired profile for aesthetic purposes. A curved "saddle cut" as illustrated in the mount 340 can be used to facilitate mounting to a post 110. In the embodiment shown, the mount 340 is attached to post 110 with attachment device 345, shown here as a bolt. Other embodiments of this device may allow attachment to a wall, ceiling, or other surface by adjusting the geometry of the mount 340 and attachment device 345 appropriately. For example, the attachment device 345 may be omitted and the mount 340 may be bonded to the receiving surface.

As depicted in the embodiment shown in FIG. 4, the handrail bracket fitting 180 includes a coupling device 355 allowing the extension 325 to attach to mount 340 in a plurality of angles, thereby allowing the handrail 185 to be mounted horizontally or at an angle. Although a preferred embodiment includes the coupling device 355, other embodiments may omit this component. Yet other embodiments may involve hinges, such as hinges similar to hinge 350 of post support fitting 122 of FIG. 6, or different styles of fixed or movable extensions 320, or other features such as a ball and socket fitting or a separable joint allowing removal of the handrail 185.

Figure 5:
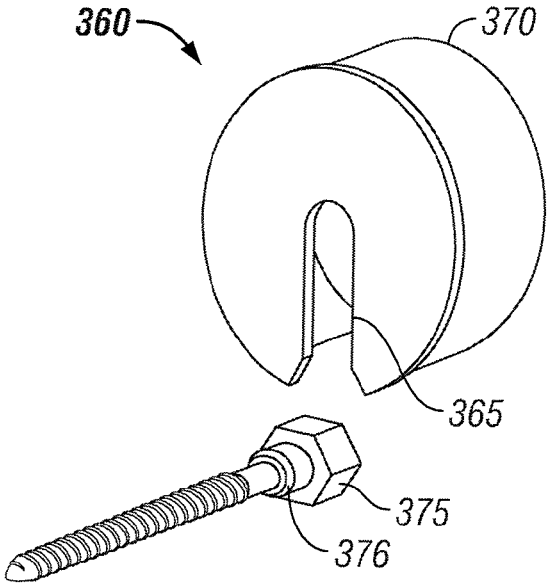
FIG. 5 is a perspective view of an embodiment of a stabilizing end cap of a component railing system in accordance with the present invention.

FIG. 5 depicts an embodiment of a stabilizing end cap 360. A stabilizing end cap 360 may be used to secure an end of a cap rail, a handrail, or a base shoe to an intersecting surface. A stabilizing end cap 360 is preferably configured with a mounting section 370 configured to be coupled with the corresponding cap rail, handrail, or base shoe. Either a male or female arrangement can be selected, as described above in greater detail with reference to post fitting section 310. Preferably, stabilizing end cap 360 is bonded to the interior of the respective cap rail, handrail, or base shoe by bonding the exterior of the mounting section 370 to the interior of the corresponding component. The stabilizing end cap 360 is attached to the intersecting surface using attachment assembly 375. Preferably, attachment assembly 375 includes one or more mechanical mounting, such as bolts, screws, and other components. Alternatively, the stabilizing end cap 360 can be bonded, glued, or attached with other methods.

In the embodiment shown in FIG. 5, attachment assembly 375 is a mechanical device having a spacer 376 that positions the head of attachment 375 a predetermined distance from the intersecting surface. Stabilizing end cap 360 is then coupled to the attachment 375 by passing slot 365 over the head of attachment 375. As should be clear, the head of attachment 375 is larger than slot 365, thereby helping to prevent undesired separation of these components in a manner other than that shown and described.

The embodiment of the stabilizing end cap 360 shown in FIG. 5 is configured to attach a horizontal cap rail 130 having an essentially circular shape to a vertical surface, such as a wall. Accordingly, the protruding portion 370 extends at a ninety degree angle from the stabilizing end cap 360. Other embodiments of a stabilizing end cap 360 may comprise a protruding portion 370 that extends at an angle other than ninety degrees in order to better accommodate non-orthogonal approach angles of cap rails, handrails, or base shoes.

Figure 6:
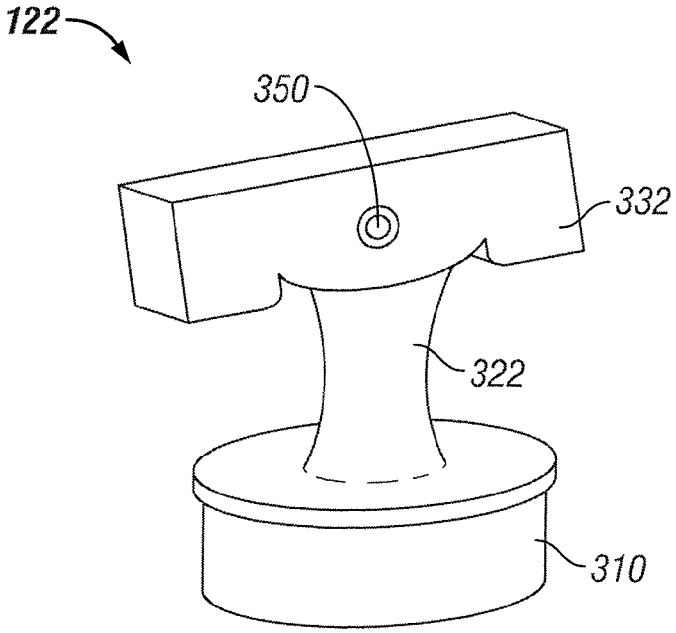
FIG. 6 is a perspective view of an embodiment of a post support fitting of a component railing system in accordance with the present invention.
Figure 7:
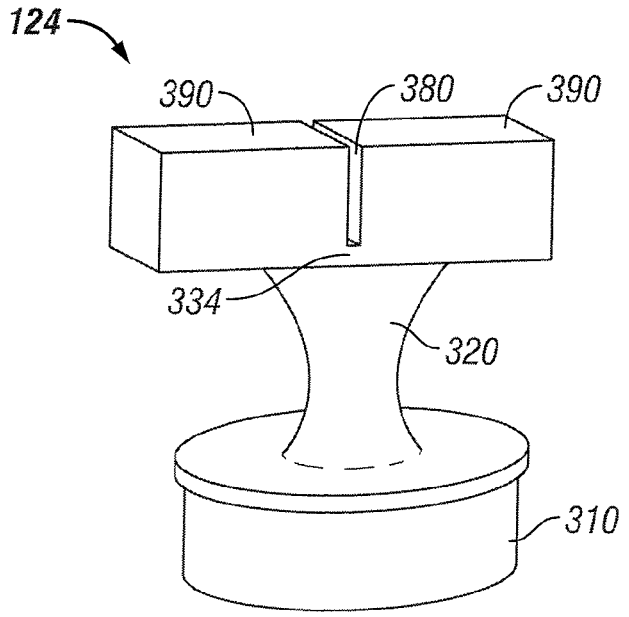
FIG. 7 is a perspective view of an embodiment of a post support fitting of a component railing system in accordance with the present invention.
Figure 8:
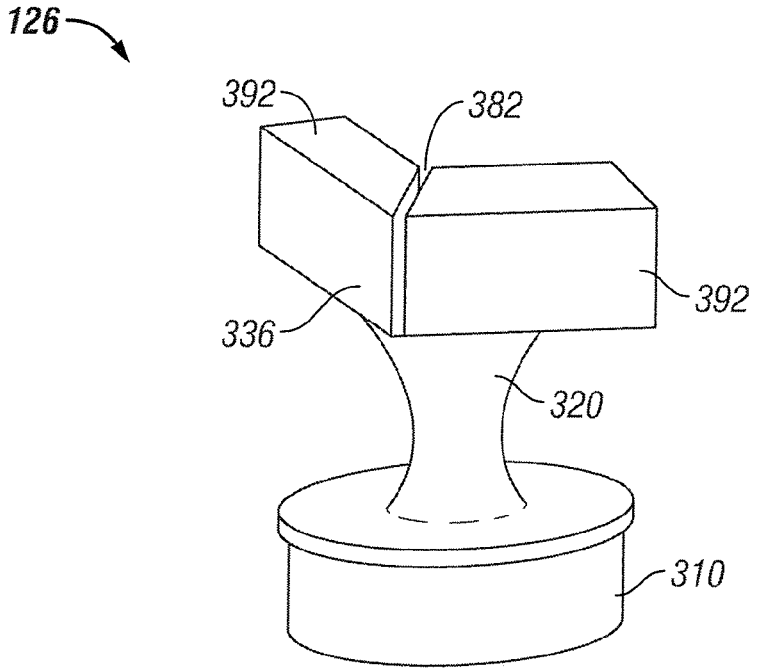
FIG. 8 is a perspective view of an embodiment of a post support fitting of a component railing system in accordance with the present invention.

Other examples of post rail fittings are illustrated in FIGS. 6, 7, and 8. Although illustrated as post support fittings, corresponding features are applicable to other components, such as the handrail bracket fittings.

The example illustrated in FIG. 6, post support fitting 122, includes extension 322 having a hinge assembly 350 that provides freedom of movement for the cap rail fitting 332 through a range of angles. This particular embodiment is particularly well adapted for mounting a cap rail, such as cap rail 130, at an angle to a vertical post 110, other than ninety degrees. In one example this would be used for posts 110 mounted on staircases. Because the cap rail fitting 332 is able to pivot, the installer may position the cap rail fitting 332 at the appropriate angle corresponding to the rise-to-run ratio of the cap rail 130, allowing for flexible use of a single component on staircases requiring different rise-to-run ratios.

FIGS. 7 and 8 depict notched or split embodiments of post support fittings, i.e., post support fittings 124 and 126. Such embodiments may be useful where an installer may wish to join a horizontal cap rail 130 to an inclined cap rail 130 at the intersection with a post 110. To facilitate this type of connection, a post support fitting 124 may be provided having a slit 380 through the cap rail fitting 334, resulting in two removable cap rail fitting halves 390. An embodiment of this structure is shown in FIG. 7. Accordingly, the installer may remove a cap rail fitting half 390 and optionally reattach it at a desired orientation by welding or other process. The first cap rail half fitting 390 may remain in place in the horizontal position, whereas the other cap rail half fitting 390 may be removed and reattached at the desired angle.

FIG. 8 depicts another embodiment of a post support fitting, i.e., post support fitting 126 constructed in accordance with the present invention and incorporating a slit 382 through a cap rail fitting 336 resulting in two cap rail fitting halves 392. This embodiment may be used to attach two cap rails 130 at an angled corner, such as at the top of a staircase. It will appreciated that a similar slit can be used with a handrail bracket fitting 180 to join handrails 185 which are not collinear.

Figure 9:
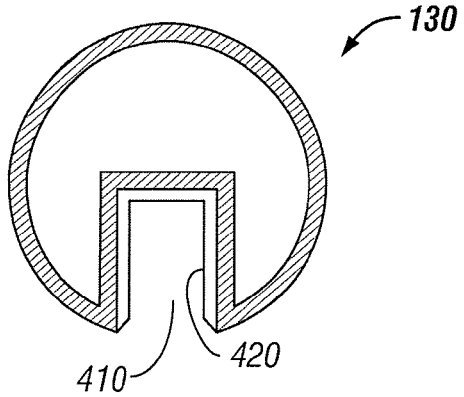
FIG. 9 is a cross-sectional view of a cap rail of a component railing system in accordance with the present invention.
Figure 10:
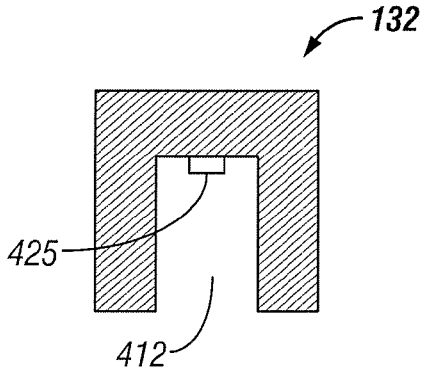
FIG. 10 is a cross-sectional view of a cap rail of a component railing system in accordance with the present invention.
Figure 11:
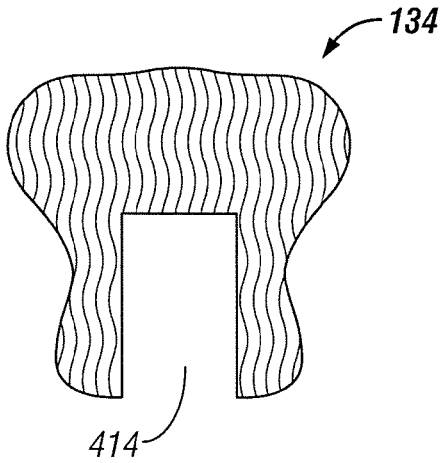
FIG. 11 is a cross-sectional view of a cap rail of a component railing system in accordance with the present invention.

Cross-sections of various embodiments of the cap rail 130 are illustrated in FIGS. 9, 10 and 11. While these embodiments vary in size and shape, each shares the feature of a cap rail channel 410 that is shown with its opening on the lower aspect of the cap rail 130. It should be understood that similar designs may be used for handrails 185.

A cap rail 130 having an essentially circular external shape with an interior channel 410 is illustrated in FIG. 9. Additionally, seat 420 is depicted, which is preferably bonded within the cap rail 130 using adhesives. The seat 420 can be made of any desired material, for example vinyl, rubber, polyvinyl chloride, or other polymer. In operation panel 150 is positioned within the seat and does not need to be bonded therein.

A cap rail having a generally angled (such as squared or rectangular) outer cross-sectional profile, i.e, cap rail 132, is illustrated in FIG. 10. Optionally a seat, similar to seat 420 of FIG. 9, can be provided within the channel 412 of cap rail 132. Another example of the many possible variations in shape and material of the cap rail, i.e., cap rail 134, is illustrated in FIG. 11. In that example, the cap rail 134 is made of wood, having a sculpted exterior surface. Optionally a seat, such as seat 420, is provided within the channel 414. Other shapes, sizes, and styles of cap rails can be configured, such as to achieve various aesthetic styling.

Likewise, additional features of a component railing system can be incorporated into the cap rail, such as a light source 425, 525 (such as an LED or other light strip or point source) mountable in the cap rail channel (or the base shoe channel), or on the end pieces 140, 190.

Similar features can be incorporated in the handrail 185. For example, an LED or other light source 187 may be incorporated in the channel along the underside or inside of the handrail 185. Also, for aesthetic purposes, a handrail end cover 186 may be attached to the end of a handrail 185.

In some embodiments of the present invention, the cap rail 130 may serve as a hand rail. However, building regulations may exist that limit the diameter of a hand rail. For example, a regulation may limit a handrail to a diameter of two inches or less. In such instances a separate handrail 185, as discussed above can be used. Alternatively, the hand rail 185 can be mounted to one or more panels 150. Still another alternative is to mount the hand rail 185 on a wall opposite the railing system, such as on a stairway. Thus, it is seen that handrails may be incorporated into embodiments of the present invention to meet aesthetic, functional, or regulatory purposes.

Figure 12:
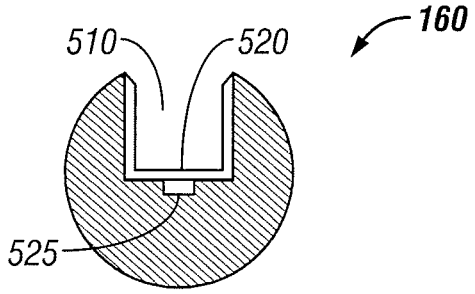
FIG. 12 is a cross-sectional view of a base shoe of a component railing system in accordance with the present invention.
Figure 13:
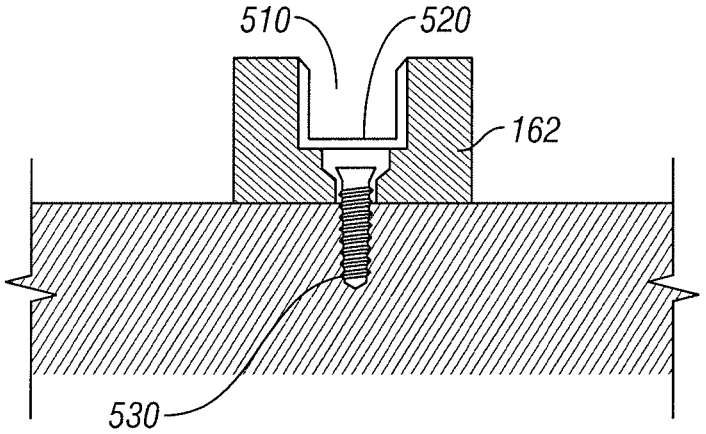
FIG. 13 is a cross-sectional view of a base shoe of a component railing system in accordance with the present invention.
Figure 14:
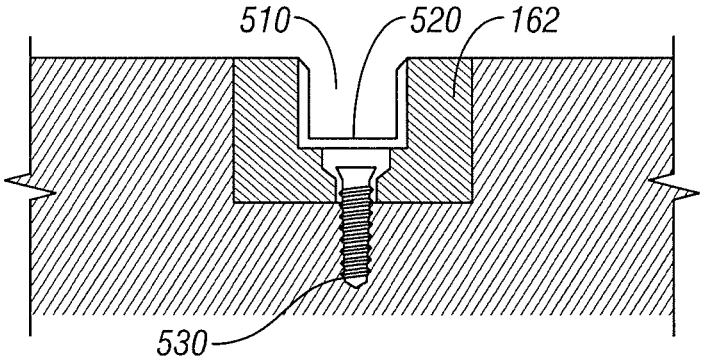
FIG. 14 is a cross-sectional view of a base shoe of a component railing system in accordance with the present invention.

FIGS. 12, 13, and 14 depict various examples of base shoes 160. In a preferred embodiment, a base shoe seat 520 is provided. The base shoe seat 520 can be made of any desired material, for example vinyl, rubber, polyvinyl chloride, or other polymer. Base shoe seat 520 is preferably constructed to fit inside channel 510 and have an exterior surface with a geometry similar to that of the interior of channel 510. Preferably the seat 520 should have a relatively smooth interior surface as appropriate to correspond to the exterior geometry of panel 150. Other embodiments may select different types of seats 520 or may choose to secure the panel 150 with cement, epoxy, or other means. Likewise, top rail seat 420 can be constructed in a similar fashion to correspond with channel 410.

FIG. 12 depicts a base shoe 160 that is curved and supported by posts 110, preferably with a bonded base shoe transition end piece 170, similar to the embodiment shown in FIG. 1. An optional light source strip 525 is illustrated as well. FIG. 13 shows a base shoe 160 with an angled shape (i.e. squared or rectangular). Such as shape is well suited for use in an embodiment in which it is desired to attach the base shoe 160 to the ground, such as illustrated in FIG. 2. An attachment assembly 530 is illustrated, such as a bolt, although any form of attachment including other fasteners, adhesives, cement or caulking can be used. Other shapes as well can be used for attachment to the ground, including rounded shapes, or rounded shapes with flat bottom surfaces. FIG. 14 depicts a base shoe 160 that is mounted in a groove in the ground or floor, such the its upper edge is flush with the floor. In the embodiment of the base shoe depicted in FIG. 14, the panel 150 appears to rise from the floor.

Figure 15:
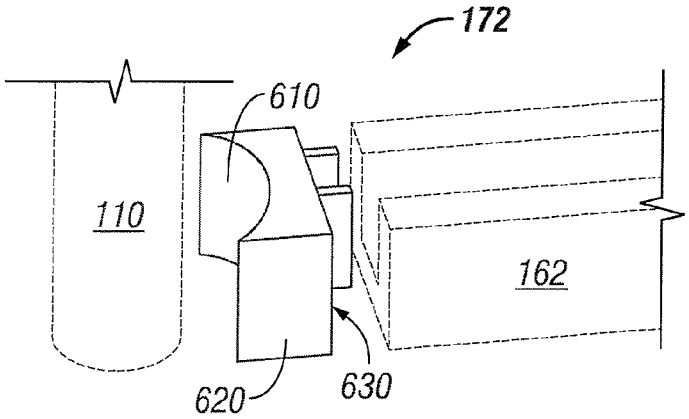
FIG. 15 is a perspective view of a base shoe transition end piece of a component railing system in accordance with the present invention.

Another example of a base shoe transition end piece 172 is illustrated in FIG. 15. This embodiment preferably is used at the end of a base shoe 162 to attach that component to a post 110. As shown, the base shoe transition end piece 172 has lateral sides 620 with essentially the same exterior configuration as the adjacent base shoe 162. One end has a curve 610 that is concave and has a similar radius of curvature as the exterior of post 110. The mounting face 630 is located opposite the curve 610 and preferably has a protruding member that can be bonded to the base shoe 162. The embodiment of the base shoe transition end piece 172 shown in FIG. 15 is preferably attached to the base shoe 162 and the post 110 such that there is no significant discontinuity in the surfaces between the base shoe 162 and the base shoe transition end piece 172.

Figure 16:
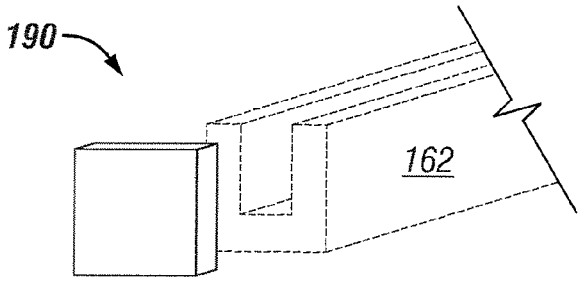
FIG. 16 is a perspective view of a base shoe end piece of a component railing system in accordance with the present invention.

FIG. 16 depicts an embodiment of a base shoe end piece 190. This embodiment preferably has a similar geometry as the adjoining base shoe 162, such that the base shoe end piece 190 fits flush with the base shoe 162. The base shoe end piece 190 preferably is held in place by either cladding tape or silicone sealant, although bonding or other means can be used as well.

Figure 17:
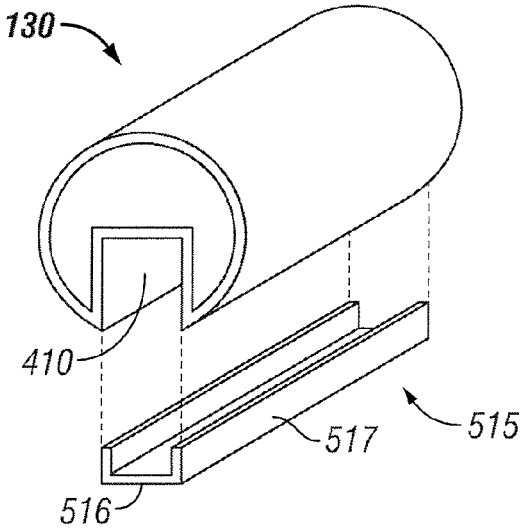
FIG. 17 is a perspective view of a pocket filler and a cap rail illustrating the orientation in a method of installing a component railing system in accordance with the present invention.

FIG. 17 is a perspective view of an example of a pocket filler 515 and a cap rail 130 assembly. The illustrated pocket filler 515 is generally u-shaped having two legs 517 spaced apart by connecting portion 516. It should be understood that any shape that is suitable for installation within a channel such as cap rail 410, base shoe 510 or handrail 185 channels may be employed. In one embodiment, the distance between the free ends of the legs 517 is slightly less than that of the receiving channel, and that distance increases toward the connecting portion 516. This design allows for an interference fit. Other embodiments may utilize leg portions 517 that are generally parallel and separated by a distance slightly smaller than the receiving channel. Such an embodiment is suited for mechanical attachment, such as bonding with adhesive, welding, cladding tape, or other mechanical fastening apparatus such as screws and bolts. The pocket filler 515 may be used in conjunction with any component having a channel such that it is sized to be positioned within the channel and retained in place as desired. Likewise any shape of pocket filler 515 can be selected that meets these criteria, including the unshaped example discussed above, or other cross-sectional shapes such as squares, rectangles, T-shapes, trapezoidal shapes etc.

In a preferred method of installing the pocket filler 515, the pocket filler 515 is first obtained in a standard "off the shelf" size, such as 2 inches, or alternatively is cut to a custom length from a larger size. Preferably, the length of the pocket filler is less than or equal to the length of the channel in which it will be installed. The pocket channel 515 preferably is inserted into the receiving channel (cap rail channel 410 in FIG. 17) and held in place by an interference fit or mechanical devices, thereby facilitating future removal. Alternatively, the pocket filler 515 may be secured by welding, bonding, or other methods.

In one example of installing a component railing system 100 in accordance with the present invention, the posts 110 are positioned in the floor. They may be secured using a surface mount, such as brackets, an embedded mount, such as cement, or other method of stabilization. Preferably, the posts 110 are oriented vertically. The assembler should also affix the post-mounted fitting 120 to the free end of the post 110. The preferred method of attachment is bonding. One example of a suitable adhesive is Metal Contact Cement 32649 and Primer for Metal Contact Cement 7649, both available from C. R. Laurence Company, although any suitable adhesive having sufficient bonding properties to affix the post-mounted fitting 120 to the post 110 can be used.

The assembler should then align the components such that the cap rail fitting 330 is oriented in the direction in which the cap rail 130 will be attached. This orientation may be facilitated with post support fittings 120 equipped with an adjustable cap rail fitting 330, such as by use of a hinge 350 or other means.

The assembler can install the cap rail 130 once installation of the post support fitting 120 is complete. The cap rail 130 is attached to the cap rail fittings 330 preferably by bonding. One example of a suitable adhesive is Metal Contact Cement 32649 and Primer for Metal Contact Cement 7649, both available from C. R. Laurence Company, although any suitable adhesive having sufficient bonding properties to affix the cap rail 130 to the cap rail fittings 330 can be used.

The base shoe 160 preferably is mounted in an orientation essentially parallel with the cap rail 130, such as at a location essentially beneath the cap rail 130. The base shoe channel 510 preferably faces the cap rail channel 410. The base shoe 160 may be installed in a variety of methods, such as by bonding to a post 110 with a transition end piece 170, fastening to a surface by welding, embedding the base shoe 160 in concrete, attaching the base shoe 160 to a strip of steel or other material embedded in concrete, or by using mechanical fasteners such as screws, bolts, or other devices.

One or more panels 150 may be installed between the cap rail 130 and the base shoe 160. Because the cap rail 130 and base shoe 160 are fixed in position, the cap rail 130 preferably is a relatively large distance from the base shoe 160 in comparison to the thickness of the panel 150 in order to facilitate installation. Likewise, the cap rail channel 410 preferably is wider than the thickness of the panel 150 to allow the panel 150 to enter that area at a slight angle during installation.

Figure 18:
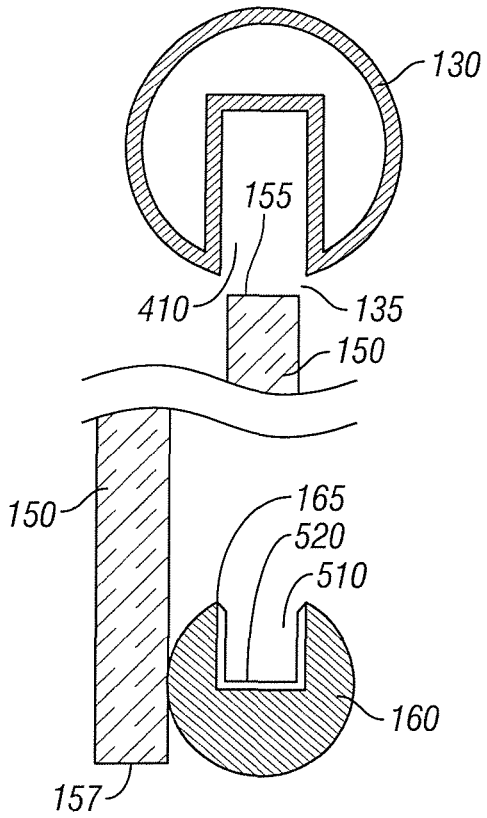
FIG. 18 is a cross-sectional view of the component railing system illustrated in FIG. 1, taken along generally corresponding to the location illustrated by line 21-21, illustrating a step in a method of installing a component railing system in accordance with the present invention.

FIGS. 18, 19, 20, and 21 are cross-sectional views illustrating examples of steps in a "lift and drop" method of installing a panel 150 between the cap rail 130 and the base shoe 160. Optionally seat 520 is bonded within the base shoe channel 510 using adhesive, and then additional adhesive is applied within the seat 520 to bond the panel 150 in place when it is installed. Seat 420 can be bonded to the cap rail 130 and optionally additional adhesive can be applied to retain the panel 150. In installation of a panel 150 in the "lift and drop" method, the panel 150 is positioned adjacent and preferably beneath the cap rail channel 410, as shown in FIG. 18. Because the height of the panel 150 preferably is greater than the distance between the lower edge 135 of the cap rail 130 and upper edge 165 of the base shoe 160, upper edge 155 of panel 150 is inserted into the cap rail channel 410 at an angle. This angle may be reduced as the distance between the cap rail 130 and the base shoe 160 is increased, or the thickness of the panel 150 is decreased. The cap rail channel 410 can also be flared at its opening to facilitate installation of the panel 150.

Figure 19:
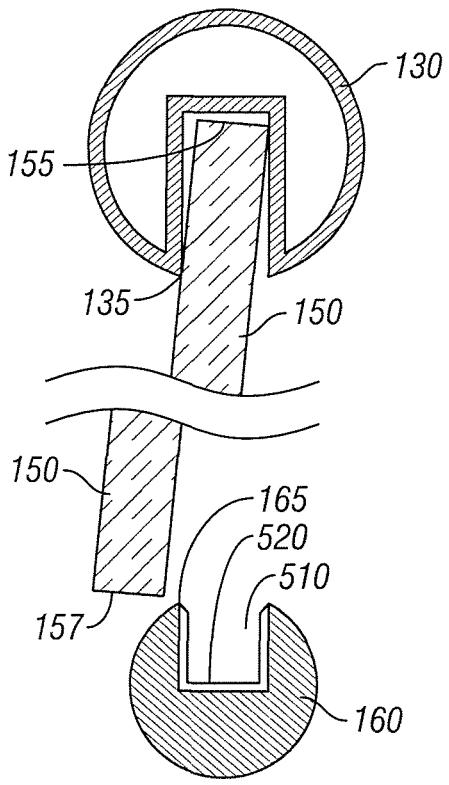
FIG. 19 is a cross-sectional view of the component railing system illustrated in FIG. 1, taken along generally corresponding to the location illustrated by line 21-21, illustrating a step in a method of installing a component railing system in accordance with the present invention.
Figure 20:
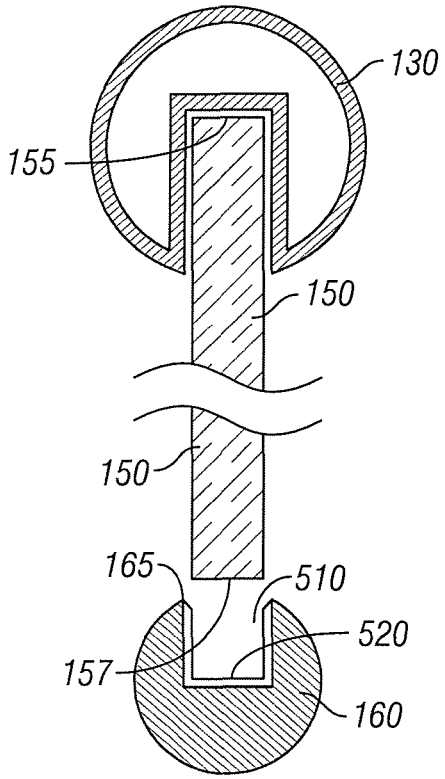
FIG. 20 is a cross-sectional view of the component railing system illustrated in FIG. 1, taken along generally corresponding to the location illustrated by line 21-21, illustrating a step in a method of installing a component railing system in accordance with the present invention.

After the upper edge 155 of the panel 150 is situated adjacent the cap rail channel 410, the panel 150 is raised such that the upper edge 155 of the panel 150 enters the cap rail channel 410, such as depicted in FIG. 19. In this configuration, the bottom edge 157 of the panel 150 should pass above at least a portion of the base shoe 160. The panel 150 is then maneuvered such that the bottom edge 157 is above the base shoe channel 510, as depicted in FIG. 20.

Figure 21:
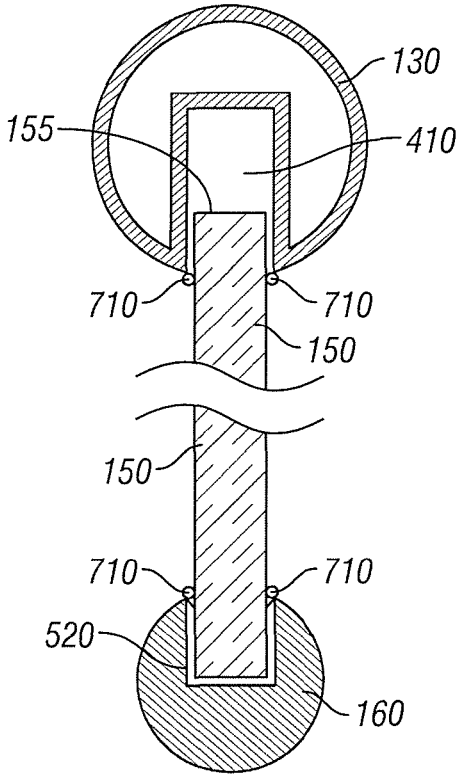
FIG. 21 is a cross-sectional view of the component railing system illustrated in FIG. 1, taken along line 21-21, illustrating a step in a method of installing a component railing system in accordance with the present invention.

Next, the panel 150 is lowered into the base shoe channel 510 and rests on optional seat 520 in an embodiment in which optional seat 520 is used. Adhesives optionally were prepositioned on the seat to bond the panel 150 in place. To help maintain the stability of the panel 150, the depth of the base shoe channel 510 preferably is less than the depth of the cap rail channel 410 and in this way a portion of the panel 150 remains within and oriented by the cap rail channel 155. Optionally a sealant or caulking 710 is applied at the edges of the cap rail 130 and the base shoe 160, as shown in FIG. 21.

One or more panels 150 may be positioned between a base shoe 160 and a cap rail 130. Additional components can be added to the assembly, such as cap rail end pieces 140, base shoe end pieces 190, handrails 185, and pocket fillers 515 within the base shoe channel 510, cap rail channel 410, handrail channel, or elsewhere.

In the preferred method of maintenance or repair, such as if a panel 150 is broken, a panel 150 may be replaced. A panel 150 preferably is replaced by first removing the existing panel 150 in its entirety, such as by reversing the installation steps or by removing any broken pieces within the base shoe channel 510 and the cap rail channel 410. Then, the replacement panel 150 as desired, optionally may be installed using the lift and drop method described above. In this embodiment, this maintenance or repair procedure does not require the removal of the cap rail 130 or the need of any customized drilling within the panel 150.

It should be understood that other embodiments of the component railing system 100 may provide panels 150 available in a variety of styles, sizes, and materials. In one such example, a series of relatively narrow panels 150 is positioned between posts 110, such as in a row of glass pickets. In one example of such an embodiment, 5-20 panels 150, i.e. pickets, are positioned between posts 110 and optionally separated by pocket fillers 515. Although FIG. 1 depicts an embodiment with three panels 150 between posts 110, it should be understood that any number of panels 150 can be used.

Thus, it is seen that a component railing system and method of assembly and maintenance are provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A component railing system mounting a plurality of planar panels, each having a vertical length, comprising:

at least one post;

a support fitting including:

a post fitting section mounting the support fitting to the post, a spacer section fixedly connected to and extending from the post fitting section, the spacer section having a first side adjacent the post fitting section, and a second side opposite the first side, a hinge, a cap rail fitting section spaced apart from the post fitting section by the spacer section, the cap rail fitting section rotatably connected to the second side of the spacer section by the hinge, whereby the angular orientation of the cap rail fitting section is determined by a degree of rotation about the hinge;

an elongated cap rail defining an elongated first channel having a first channel depth, the cap rail spaced apart from the at least one post by the support fitting, the cap rail mounted on the post by positioning the cap rail fitting section within a portion of the first channel; and a base shoe mounted either on a ground or on the post in a substantially fixed relation to the cap rail, and spaced apart from the cap rail by a rail spacing distance that is less than the vertical length of a panel, the rail spacing distance being the shortest distance between any point on the respective base shoe and corresponding cap rail, and the base shoe defining a second channel having a second channel depth, wherein:

the first channel depth is greater than the second channel depth; and the sum of the first channel depth, the second channel depth and the rail spacing distance is greater than the vertical length of the panel, and wherein, the panel includes a top side and a bottom side, the top side being positioned within the first channel and the bottom side being positioned within the second channel, the panel being slidably insertable between the cap rail and the base shoe by lifting it within the first channel sufficiently so that its bottom side is above the base shoe and then allowing the bottom side to slide within the second channel.

2. The component railing system of claim 1 wherein the support fitting further includes:

a rail mounting section configured to be received within the first channel;

a support structure mounting section; and a hinge, the hinge rotatably connecting the rail fitting section and the mounting section.

3. The component railing system of claim 1, further comprising a transition end piece connecting the base shoe and the at least one post.

4. The component railing system of claim 3, wherein the transition end piece comprises:

a first lateral face receiving a lateral surface of the at least one post; and a second lateral face opposite to the first lateral face, the second lateral face comprising one or more protrusions configured to be coupled with the base shoe.

5. The component railing system of claim 1, further comprising at least one pocket filler disposed in the cap rail.

6. The system of claim 1 wherein a sealant is applied at one or more of first and second edges of the cap rail and the base shoe.

7. The component railing system of claim 1 wherein:

the at least one post includes a first vertical post and a second vertical post horizontally spaced apart from the first post, wherein the first post and the second post have respective top sides, the elevation of the top side of the first post being at a different elevation from the elevation of the top side of the second post;

each of the first and second posts having a respective first and second support fitting;

the cap rail extending between the first and second post, and mounted to each post by its respective support fitting;

the angular rotation of the cap rail fitting section of each of the first and second support fitting being substantially the same and mounting the cap rail at a non-horizontal angle.

8. The component railing system of claim 1 further comprising an adhesive layer binding the cap rail to the cap rail fitting section.

9. A component railing system comprising:

at least one post;

a support fitting including:

a post fitting section mounting the support fitting to the post, a tapered spacer section fixedly connected to and extending from the post fitting section, the spacer section having a maximum cross-sectional dimension that is smaller than that of the post fitting section, and the spacer section having a first side adjacent the post fitting section, and a second side opposite the first side, a cap rail fitting fixedly connected to the spacer section spaced apart from the post fitting section, the cap rail fitting section including at least two mounting parts spaced apart from one another, both parts being fixedly connected to the spacer sections;

a first elongated cap rail defining an elongated first channel having a first channel depth, the cap rail spaced apart from the at least one post by the support fitting, the cap rail mounted on the post by positioning at least one of the mounting parts of the cap rail fitting section within a portion of the first channel; and a base shoe mounted either on a ground or on the post in a substantially fixed relation to the cap rail, and spaced apart from the cap rail by a rail spacing distance, the rail spacing distance being the shortest distance between any point on the respective base shoe and corresponding cap rail, and the base shoe defining a second channel having a second channel depth.

10. The system of claim 9 wherein a sealant is applied at one or more of first and second edges of the cap rail and the base shoe.

11. The component railing system of claim 9 wherein the at least two mounting parts of the cap rail mounting section include:

a first mounting part mounted to the spacer section at a first angle; and a second mounting part mounted to the spacer section at a second angle that is different from the first angle.

12. The component railing system of claim 11 wherein the first cap rail is mounted on the first mounting part and further comprising a second cap rail mounted on the second mounting part at an angle other than 180 degrees in relation to the first cap rail.

13. The component railing system of claim 11 further comprising a panel mounted between the rail and the base shoe, wherein the panel includes a top side and a bottom side, the top side being positioned within the first channel and the bottom side being positioned within the second channel, the panel being insertable between the first cap rail and the base shoe by lifting it within the first channel sufficiently so that its bottom side is above the base shoe and then allowing the bottom side to slide within the second channel.

14. The component railing system of claim 9 further comprising a panel mounted between the rail and the base shoe, wherein:

the rail spacing distance is less than the vertical length of the panel;

the first channel depth is greater than the second channel depth; and the sum of the first channel depth, the second channel depth and the rail spacing distance is greater than the vertical length of the panel.

* * * * *